United States Patent [19]

Owens

[11] 4,168,994

[45] Sep. 25, 1979

[54] THERMAL HOMOGENIZATION OF STEAM GENERATING TUBING

[75] Inventor: Clark M. Owens, Colchester, Conn.

[73] Assignee: Combustion Engineering, Inc., Windsor, Conn.

[21] Appl. No.: 959,803

[22] Filed: Nov. 13, 1978

[51] Int. Cl.[2] ..... C21D 9/08

[52] U.S. Cl. ..... 148/12 E; 148/12 EA

[58] Field of Search ..... 148/12 R, 12 E, 12 EA

[56] References Cited

U.S. PATENT DOCUMENTS

| | | | |
|---|---|---|---|
| 3,844,846 | 10/1974 | Friske et al. | 148/12 E |
| 4,070,209 | 1/1978 | Usui | 148/12 E |

*Primary Examiner*—W. Stallard

*Attorney, Agent, or Firm*—Wayne H. Lang

[57] ABSTRACT

Homogenization of nickel-chromium-iron alloy tubing to accomplish carbon stabilization is effected before the tubing is cold worked to its final length by subjecting the alloy to two successive short and closely controlled periods of annealing in a batch-type annealing furnace.

15 Claims, 1 Drawing Figure

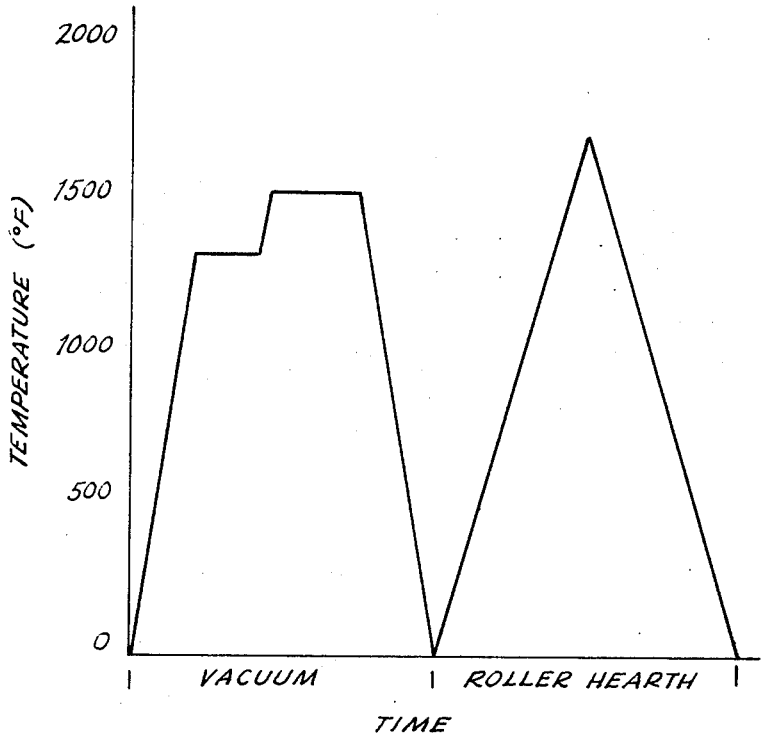
2000
1500
1000
500
0
TEMPERATURE (°F)
VACUUM
ROLLER HEARTH
TIME

THERMAL HOMOGENIZATION OF STEAM GENERATING TUBING

BACKGROUND OF THE INVENTION

This invention relates to a heat treating process for the homogenization of nickel-chromium-iron alloy tubing wherein essentially all of the carbon and some of the chromium of the alloy are removed from solid solution to form grain boundary carbide precipitates by a process called sensitization. Continued heating permits chromium to be diffused to restore chromium in the chromium depleted areas associated with the carbide precipitates by a process known as desensitization.

In current practice, it is common to subject finally sized tubing as long as 85 feet in length to a thermal treatment by which mill annealed tubing is placed in an elongate batch type furnace approximately 100 feet in length before it is subjected to a combination sensitization/desensitization isothermal anneal at a temperature of 800° F. to 1400° F. In such a process the carbon is first removed from solid solution in the form of chromium carbide precipitates, while continued heating of the alloy for a protracted period of time permits rediffusion of chromium to produce an alloy that is resistant to acid attack.

A disadvantage of this current practice is that the heat treating time of from 15 to 16 hours at an elevated temperature is prohibitively excessive. Moreover, this process requires an excessively long batch type heat treating facility with a long hot zone to handle the tubing lengths of approximately 85 feet. Such a furnace facility may cost from 3 to 5 million dollars to install and an excessive amount to operate, and is an extremely slow process to carry out.

A typical furnace of the type referred to in this invention heat treats the alloy tubing in any one of its cold worked intermediate stages, before it is cold worked to its final length, thereby permitting the use of a relatively short furnace with a short hot zone, a furnace that is typically existing equipment in most mills.

SUMMARY OF THE INVENTION

This invention is therefore directed to a process for the heat treating of nickel-chromium-iron alloy tubing that is effected early in the manufacturing process, before the tubing has attained its final length. Two relatively short isothermal anneals are effected to homogenize the tubing at any one of several cold worked states in the process including the initial cold reduction. Both isothermal anneal treatments are carried out in a single batch type furnace by simply increasing the annealing temperature from the sensitizing range to the desensitizing range for a short period of time.

Paramount to the success of this process is the fact that chromium carbides formed during homogenization do not have associated therewith chromium depleted zones after desensitization and the recrystallized grain boundaries formed during final annealing are free from carbide precipitation. The latter is such because the carbon required to form particles has been locked up during homogenization. Tubing homogenized in this manner can be safely reheated into the sensitization range, as in stress relieving, and carbides will not develop.

Accordingly, the process of this invention economically and rapidly provides tubing alloy with the same properties of corrosion resistance provided by large multi-million dollar heat treating facilities using a conventional process.

BRIEF DESCRIPTION OF THE DRAWING

Other objectives and the particular process of the invention will become more apparent from the specification and the accompanying drawing in which:

The single FIGURE is a temperature-time diagram that graphically shows the process of the invention.

DESCRIPTION OF THE PREFERRED EMBODIMENT

In the invention, homogenization with its attendant advantages is effected to accomplish carbon stabilization and chromium diffusion early in the tube making process before material from which the tubing is being made is cold reduced to its final length where it is long and inconvenient to handle.

Accordingly, a billet of the alloy is first drilled and extruded. Subsequently, an initial cold reduction produces a first intermediate product in the tube making process. The first intermediate product is softened by a process of "recrystallization annealing" and then cold-worked additionally for a further elongation of the tubes. However, before the product has attained a length of 20–25 feet, the conveniently sized cold worked product is subjected to heat treating in a conventional batch type annealer for one to two hours at 1200° F. to 1325° F. This anneal is designed to heat the alloy to the sensitization range to stabilize the carbon in the form of chromium carbide particles. This initial treatment must maximize the formation of carbides and chromium depleted zones.

A second anneal is subsequently performed for a somewhat longer period of time at a desensitizing temperature to permit chromium rediffusion to "heal" the chromium depleted zones associated with each carbide. This heat treating or period of anneal is carried out by simply increasing the temperature to 1500° F.–1600° F. for about three hours time, immediately after completion of the first period of heat treating. Inasmuch as this stage of heat treating is effected immediately after the first anneal, it is carried out in the same batch type furnace in the absense of a surrounding atmosphere. After being maintained at a temperature of from 1500° F. to 1600° F. for a period of up to three hours, the furnace is allowed to cool and the intermediate sized tubes are removed therefrom. Homogenization of any cold worked intermediate product, other than the final intermediate product requires recrystallization annealing without dissolving the carbides. For a case where homogenization is imparted at the final intermediate product stage, after cooling, the tubes are subjected to a final cold reduction whereby they are increased to their final length up to 85 feet, after which they are subjected to final heat treatment in a relatively long roller hearth furnace. The maximum temperature at this stage of the process is about 1700° F. attained in a hydrogen atmosphere. The temperature is selected to obtain the desired mechanical properties without dissolving the carbide particles created in the homogenization annealing treatment. The alloy material is raised to the maximum temperature for a short period of time of approximately one-half hour, whereupon it is permitted to cool in hydrogen followed by air to the ambient temperature to attain the benefits of a fully homogenized tube.

The heat treating process of this invention is represented by the single FIGURE of the drawing where a simple time-temperature diagram is used to indicate the two successive isothermal anneals in a bath type annealing furnace. The two isothermal anneals in a batch-type furnace are followed by a further cold working and a final annealing carried out in a roller hearth furnace.

What is claimed is:

1. A process for the manufacture of nickel-chromium-iron alloy tubing comprising the steps of forging a billet, forming a hole longitudinally through said billet, extruding the billet to form a tube hollow, cold working the tube hollow to form an intermediate product of less than 25 feet, and homogenizing said intermediate product to accomplish carbon stabilization and chromium diffusion by subjecting the cold worked intermediate product to two successive isothermal anneals.

2. A process as defined in claim 1 wherein the first anneal is at from 1200° F. to 1325° F. for a period of approximately 2 hours.

3. A process as defined in claim 2 wherein the second anneal is at from 1500° F. to 1600° F. for a longer period of time.

4. A process as defined in claim 3 wherein the second anneal is maintained at a temperature of 1500° F. to 1600° F. for a period of from 2 to 5 hours duration.

5. A process as defined in claim 4 further characterized in that the two successive isothermal anneals are effected in a vacuum-type batch furance.

6. A process as defined in claim 5 wherein the intermediate product is cooled to the ambient temperature after the second isothermal anneal.

7. A process as defined in claim 6 wherein the intermediate product is subjected to a final tube reduction operation and then a final heat treatment of up to 1700° F.

8. A process as defined in claim 7 wherein the final heat treatment is carried out in a roller hearth furnace having a hydrogen atmosphere.

9. A process as defined in claim 8 wherein the alloy of the tube is permitted to cool immediately after reaching a temperature of up to 1700° F.

10. A process for the homogenization of alloy tubing requiring the successive heat treatment of a work hardened product in a heat treating furnace, the first heat treatment being at 1200° F. to 1325° F. for less than two hours, and the second heat treatment period being for more than two hours at from 1500° F. to 1600° F.

11. A process as defined in claim 9 further characterized in that the first and second heat treatment periods are effected in a batch-type furnace having a substantial vacuum therein.

12. A process as defined in claim 1 wherein the first anneal is maintained at a sensitization temperature for a period of time sufficient to maximize the formation of carbides and chromium depleted zones.

13. A process as defined in claim 12 wherein the second anneal is at a temperature above the sensitization range but lower than the carbide dissolution temperature.

14. A process as defined in claim 13 wherein the second anneal is maintained at a desensitization temperature for a period of time sufficient to heal the chromium depleted zones.

15. A process as defined in claim 14 for the homogenization of alloy tubing requiring the successive heat treatment of a work hardened product in a heat treating furnace, the first heat treatment being at a temperature in the sensitization range, and the second heat treatment being at a temperature above the sensitization range but below the carbide dissolution temperature.

* * * * *

UNITED STATES PATENT AND TRADEMARK OFFICE

CERTIFICATE OF CORRECTION

PATENT NO. : 4,168,994

DATED : September 25, 1979

INVENTOR(S) : Clark M. Owens

It is certified that error appears in the above—identified patent and that said Letters Patent is hereby corrected as shown below:

Column 3, Claim 7, last line, delete "of up to 1700°F"and insert thereof --at a recrystallization temperature below the carbide dissolution temperature--

Column 4, Claim 9, lines 2 and 3, delete "immediately after reaching a temperature of up to 1700°F" and insert thereof --after being subjected to the final heat treatment--

Signed and Sealed this

*Twentieth* Day of *January 1981*

[SEAL]

*Attest:*

RENE D. TEGTMEYER

*Attesting Officer*

*Acting Commissioner of Patents and Trademarks*